US006935877B2

(12) United States Patent
Liao

(10) Patent No.: US 6,935,877 B2
(45) Date of Patent: Aug. 30, 2005

(54) PLUG CONNECTOR FOR USE IN STANDARD TRANSFER

(76) Inventor: Sheng Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 10/774,511

(22) Filed: Feb. 10, 2004

(65) Prior Publication Data

US 2005/0148232 A1 Jul. 7, 2005

(30) Foreign Application Priority Data

Jan. 6, 2004 (TW) ..... 93200185 U

(51) Int. Cl.[7] ..... H01R 4/24

(52) U.S. Cl. ..... 439/170; 439/177; 439/218

(58) Field of Search ..... 439/418, 941, 439/409, 676, 344, 76.1, 576, 404, 170, 177, 439/217, 218, 628

(56) References Cited

U.S. PATENT DOCUMENTS

| | | | | |
|---|---|---|---|---|
| 4,714,440 | A * | 12/1987 | Hutchins | 439/676 |
| 6,113,432 | A * | 9/2000 | Liao | 439/638 |
| 6,116,960 | A * | 9/2000 | Lloyd et al. | 439/668 |
| 6,364,715 | B1 * | 4/2002 | Liu et al. | 439/638 |
| 6,439,920 | B1 * | 8/2002 | Chen | 439/418 |
| 6,454,590 | B1 * | 9/2002 | Goodrich et al. | 439/357 |
| 6,482,039 | B2 * | 11/2002 | Phommachanh et al. | 439/620 |
| 6,506,070 | B1 * | 1/2003 | Huang | 439/352 |
| 6,604,966 | B1 * | 8/2003 | Hayes et al. | 439/752 |
| 6,683,460 | B2 * | 1/2004 | Huang | 324/538 |

* cited by examiner

*Primary Examiner*—Renee Luebke
*Assistant Examiner*—Phuongchi Nguyen
(74) *Attorney, Agent, or Firm*—Rosenberg, Klein & Lee

(57) ABSTRACT

A plug connector for use with jacks of different standards has an insulating housing, a plurality of terminals and an adapter sleeve. The insulating housing has a plurality of terminal grooves formed in a front end thereof. The terminals are respectively arranged in the terminal grooves. The adapter sleeve is coupled on the insulating housing, and the adapter sleeve is moveably adjusted at a predetermined position to adapt the plug to one of two standards.

10 Claims, 10 Drawing Sheets

PLUG CONNECTOR FOR USE IN STANDARD TRANSFER

BACKGROUND OF THE INVENTION

1. Field of the Invention

The present invention relates to a plug connector and, more particularly to a plug connector having an adapter sleeve for use with jacks of different standards.

2. Description of the Related Art

Referring to FIGS. 1A and 1B, a conventional plug connector has a portion electrically connected to a plurality of conductive lines. The plug connector can be applied for the connection of a computer or a telephone. The plug connector includes an insulating housing 10*a*, a tongue element 11*a* for providing a hooking function and a plurality of terminals 12*a* arranged within the insulating housing 10*a*. The terminals 12*a* can be longitudinally moved a short distance. When the conductive lines 20*a* are connected to the plug connector, the conductive lines 20*a* can be inserted from the rear end of the insulating housing 10*a*. The conductive lines 20*a* can be extended into the insulating housing 10*a*, and the outer layer of the conductive lines 20*a* can be pierced by the terminals 12*a*, so that the terminals 12*a* and the conductive lines 20*a* will achieve an electrical connection.

However, the conventional plug connectors respectively have different standards, i.e. two insulating housings 10*a* respectively have a width "a" and "b" (shown in FIGS. 1A and 1B). The size of each insulating housing 10*a* is constant, and thus the conventional plug connecter can only adapt to one standard. Each insulating housing 10*a* fails to adapt simultaneously to two standards, such as six pins and eight pins. Furthermore, when a factory owner needs to manufacture different standards of plug, and he must renew the molding to manufacture different size of insulating housing, thereby raising manufacturing costs.

SUMMARY OF THE INVENTION

It is therefore a principal object of the present invention to provide a plug connector for use with jacks of different standards, where an insulating housing of a plug, with a uniform size, is adaptable for use with jacks of two standards, so that the manufacturing cost thereof can be effectively reduced, and it is extremely simple and easy to obtain the adaptability. Furthermore, the present invention has been accomplished to eliminate the aforesaid problem.

In order to achieve the above object, a plug connector includes an insulating housing, a plurality of terminals and an adapter sleeve. The insulating housing has a plurality of terminal grooves formed in a front end thereof. The terminals are respectively arranged in the terminal grooves. The adapter sleeve is coupled on the insulating housing, and the adapter sleeve is moveably adjusted at a predetermined position on the insulating housing to adapt to different standards.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1A:
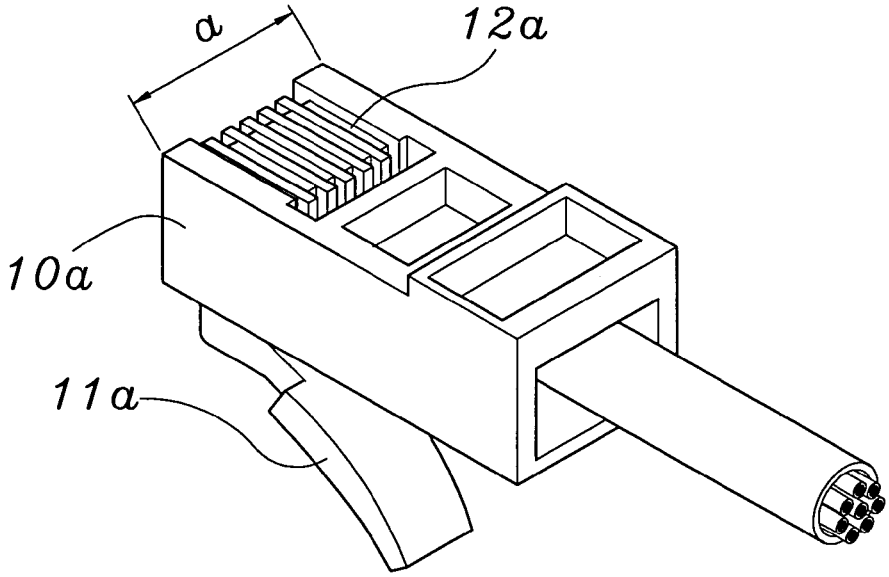
FIG. 1A PRIOR ART
FIG. 1A is a perspective view of a plug connector of a prior art.
Figure 1B:
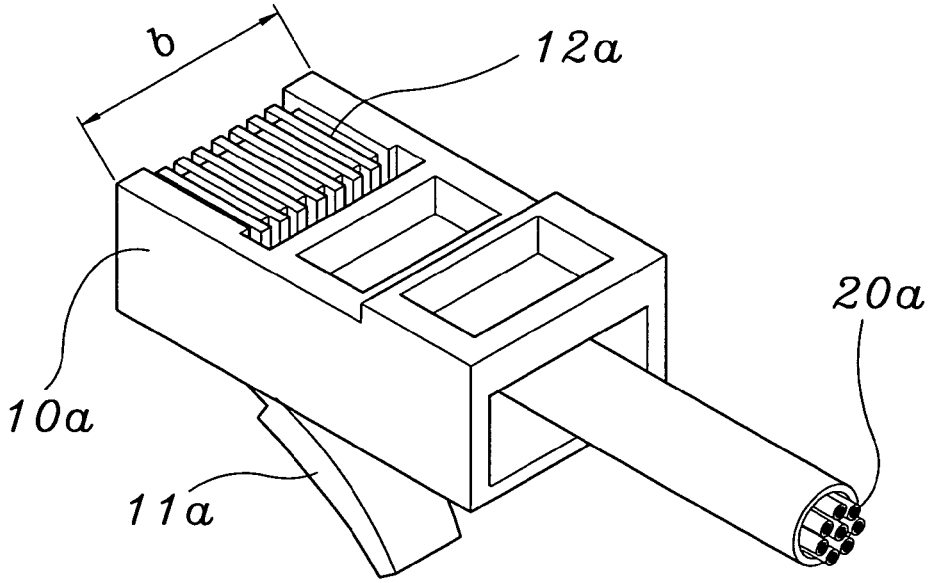
FIG. 1B PRIOR ART
FIG. 1B is a perspective view of a plug connector with another standard of the prior art.

Wherever possible in the following description, like reference numerals will refer to like elements and parts unless otherwise illustrated.

Figure 2:
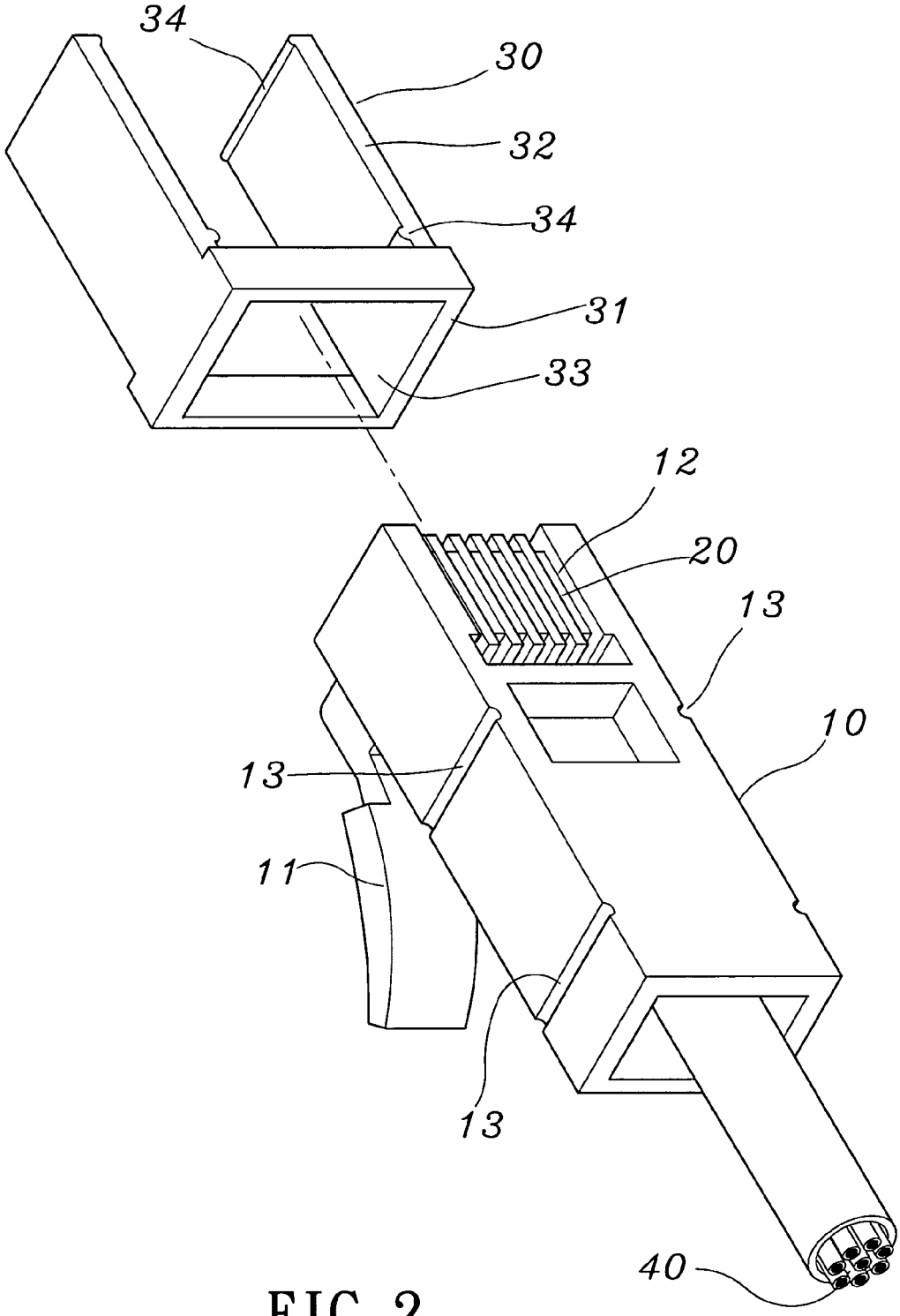
FIG. 2 is an exploded perspective view of a plug connector of a first embodiment of the present invention.
Figure 3:
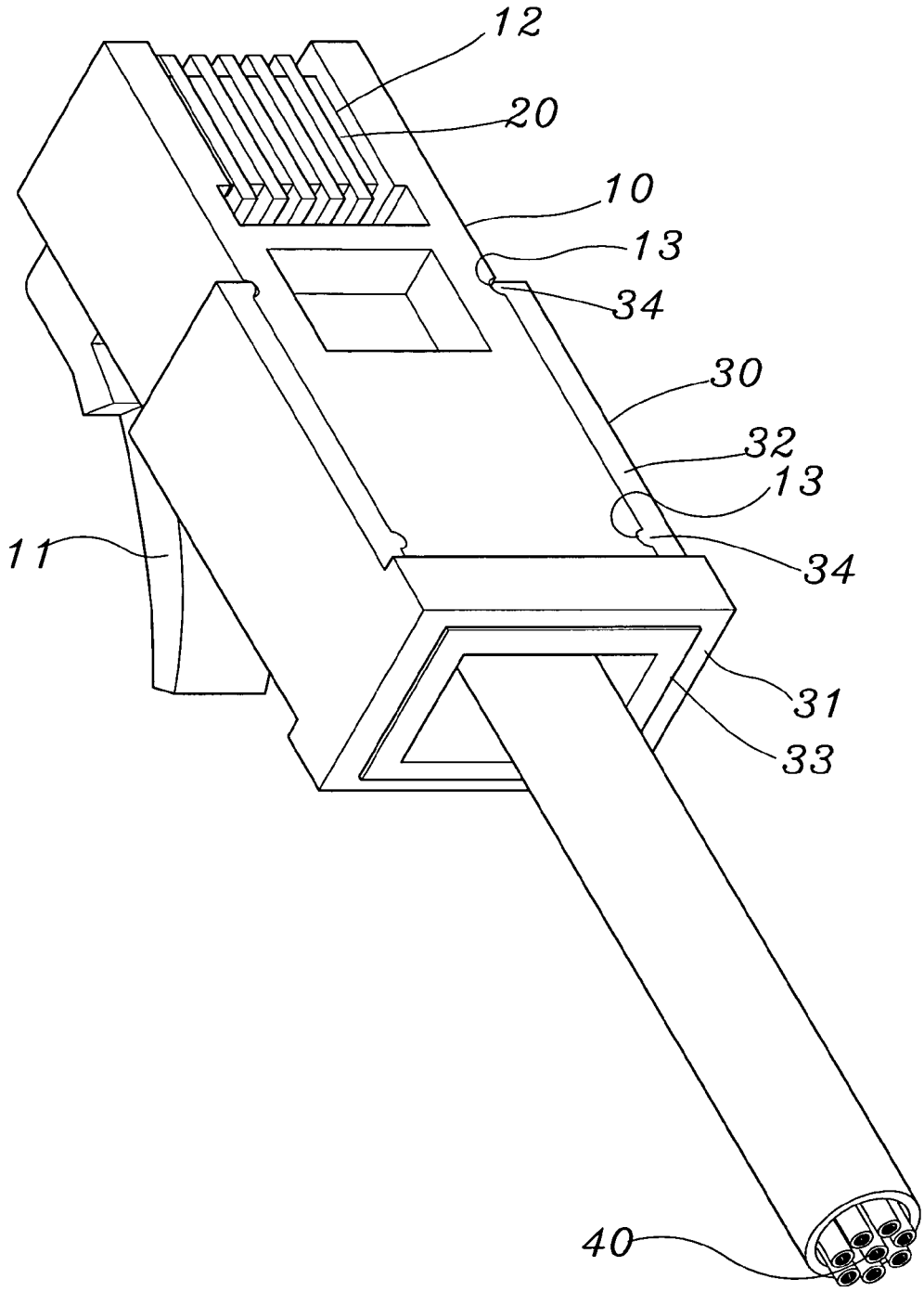
FIG. 3 is a perspective view of the plug connector of the first embodiment of the present invention.

With reference to FIGS. 2 to 3, the present invention provides a plug connector for use in coupling to jacks of different standards including an insulating housing 10, a plurality of terminals 20 and an adapter sleeve 30. The insulating housing 10 is made of an insulating material, such as, for example, plastic. The inside of the insulating housing 10 is hollow. The insulating housing 10 has a tongue element 11 formed on an outer side thereof for positioning the plug in a jack and providing releasable latching engagement therewith. The insulating housing 10 has a plurality of terminal grooves 12 equidistantly formed in a front end thereof. The terminal grooves 12 are in communication with the inside of the insulating housing 10. The insulating housing 10 includes a plurality of slots 13 formed in two opposite sides of a middle position and a rear position thereof for positioning the adapter sleeve 30.

Each of the terminals 20 is made of a conductive material, such as, for example, copper. The terminals 20 are respectively arranged in the terminal grooves 12. Each terminal 20 has a piercing end (not shown) for electrically connecting with a plurality of conductive lines 40.

The adapter sleeve 30 is made of an insulating material, such as, for example, plastic. The adapter sleeve 30 has a main body 31 and two arms 32. The main body 31 is substantially rectangular in shape. The width of the main body 31 is larger than that of the insulating housing 10. The main body 31 has a receiving opening 33 according to the width of the insulating housing 10. The two arms 32 can be integrally formed on two sides of the main body 31. Each arm 32 has two protrusions 34 respectively projecting inward from a front position and a rear position thereof. The two protrusions 34 are respectively hooked into the slots 13 at two sides of the insulating housing 10.

The adapter sleeve 30 is coupled on the insulating housing 10 via the receiving opening 33. The adapter sleeve 30 can be moveably adjusted at a predetermined position (such as a first position or a second position) on the insulating housing 10.

Figure 4:
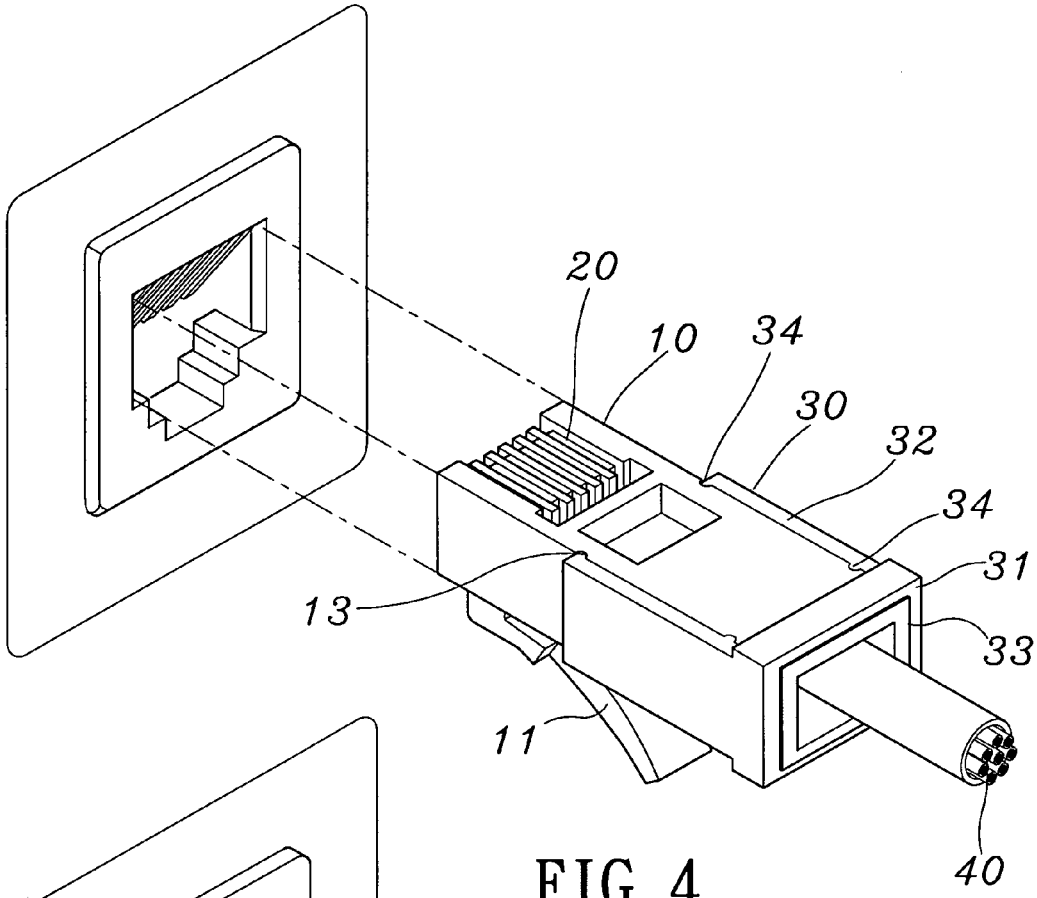
FIG. 4 is a perspective view of the plug connector of the first embodiment of the present invention while a using condition.

When the adapter sleeve 30 is backward moved into the first position (shown in FIGS. 3 and 4), the protrusions 34 of the two arms 32 are respectively hooked into the slots 13 at the two sides of the middle position and the rear position of the insulating housing 10, thereby to define a positioning mechanism. Thus the adapter sleeve 30 can be securely positioned at a rear-half portion of the insulating housing 10.

Figure 5:
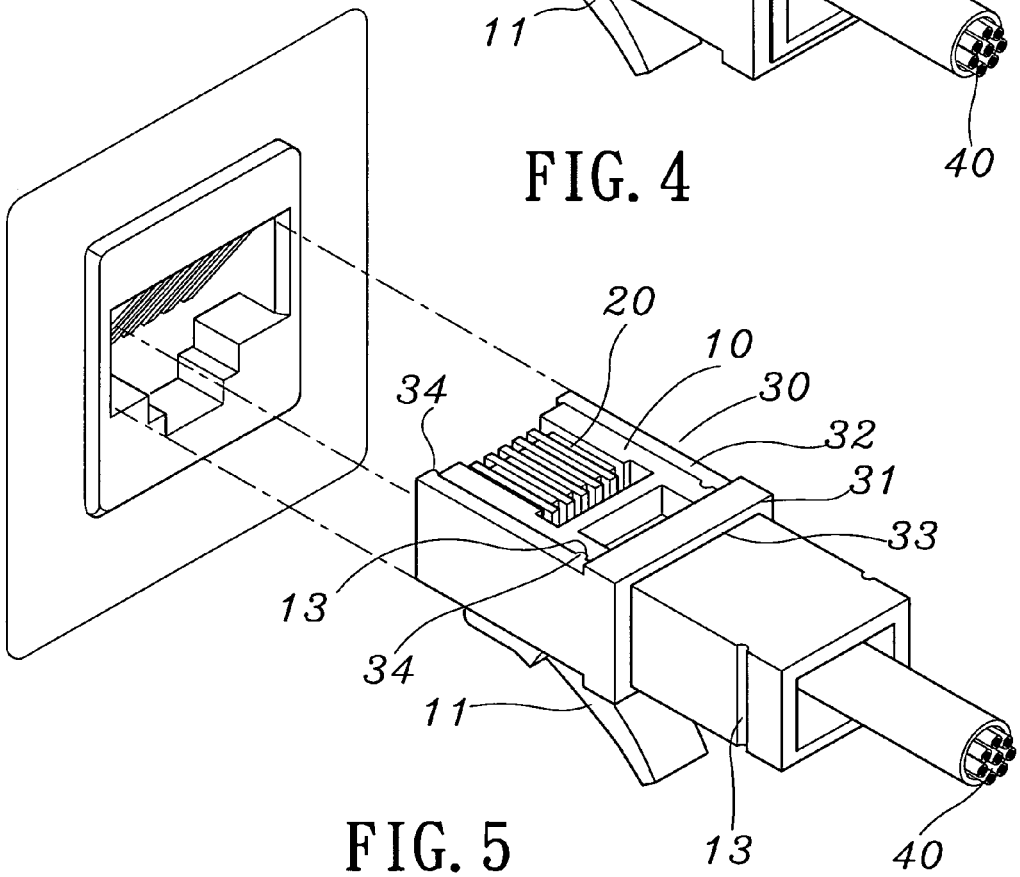
FIG. 5 is a perspective view of the plug connector of the first embodiment of the present invention while using another using condition.
Figure 6:
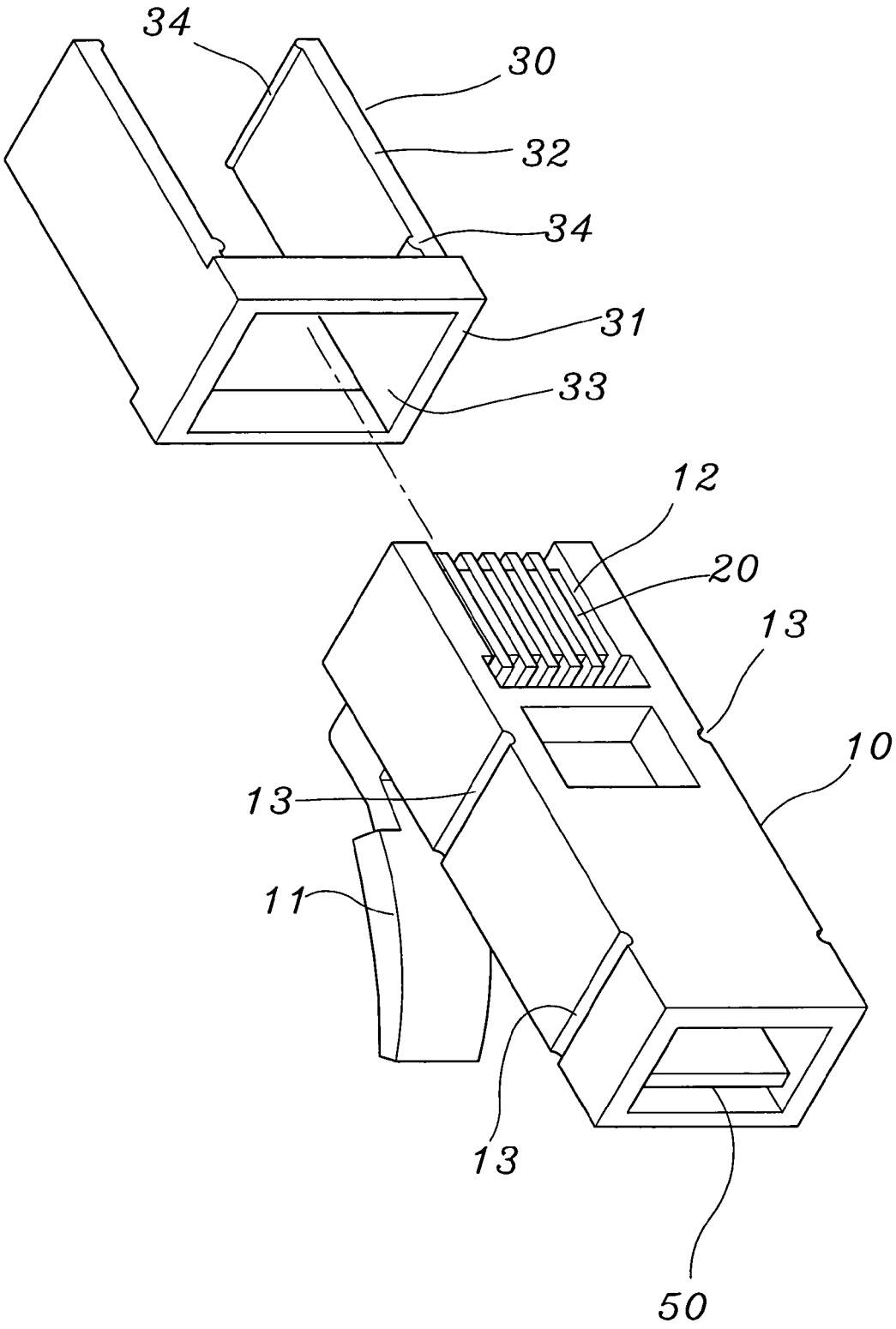
FIG. 6 is an exploded perspective view of a plug connector of a second embodiment of the present invention.
Figure 6A:
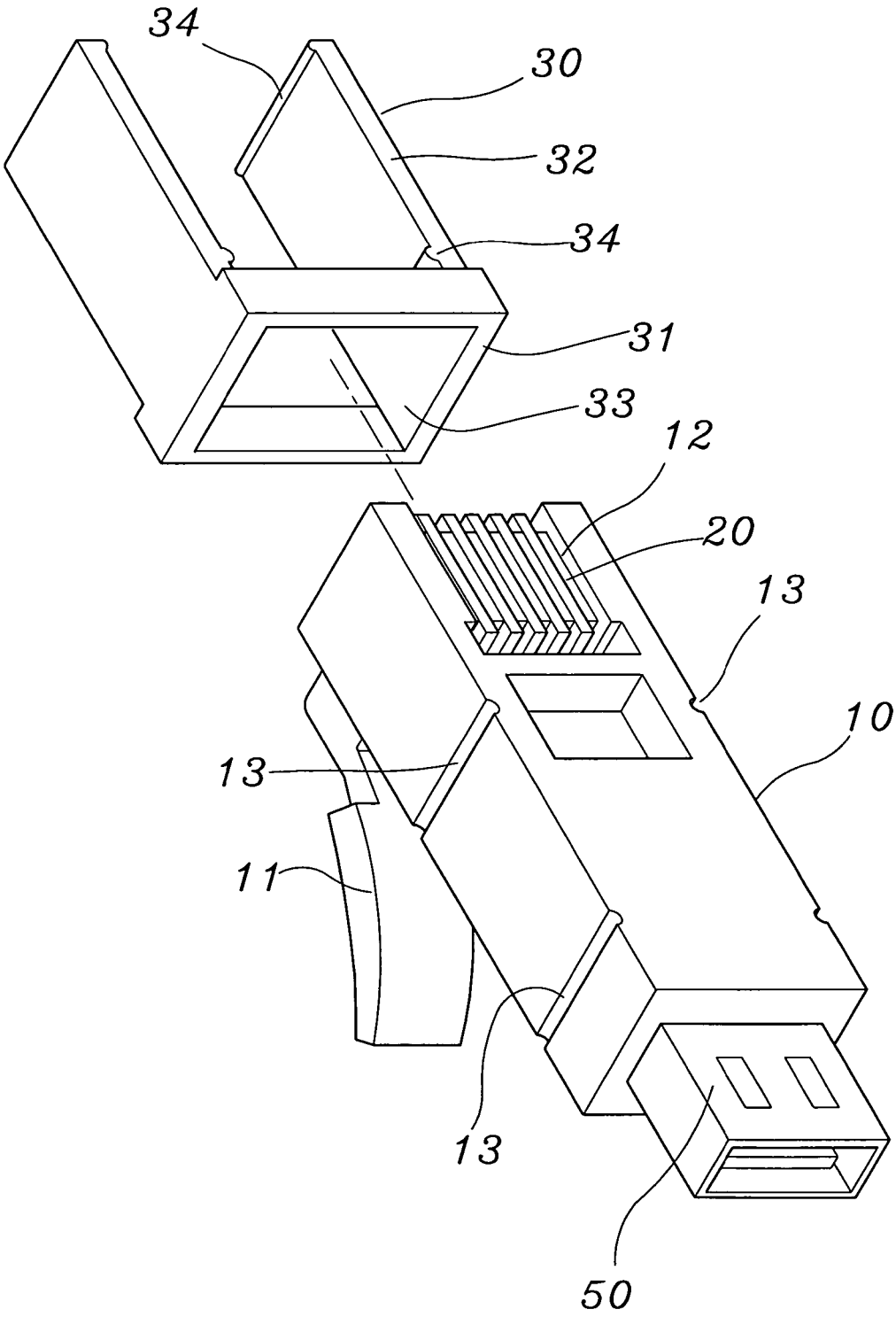
FIG. 6A is an exploded perspective view of the plug connector of the second embodiment of the present invention of another type.
Figure 7:
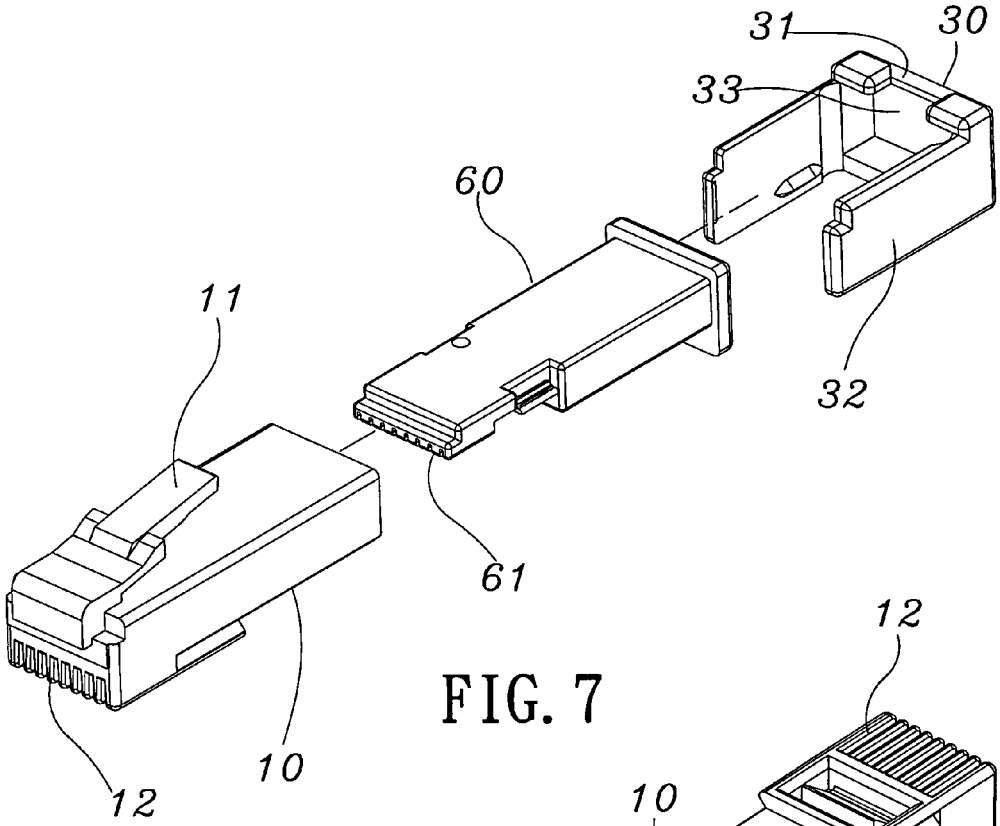
FIG. 7 is an exploded perspective view of a plug connector of a third embodiment of the present invention.
Figure 8:
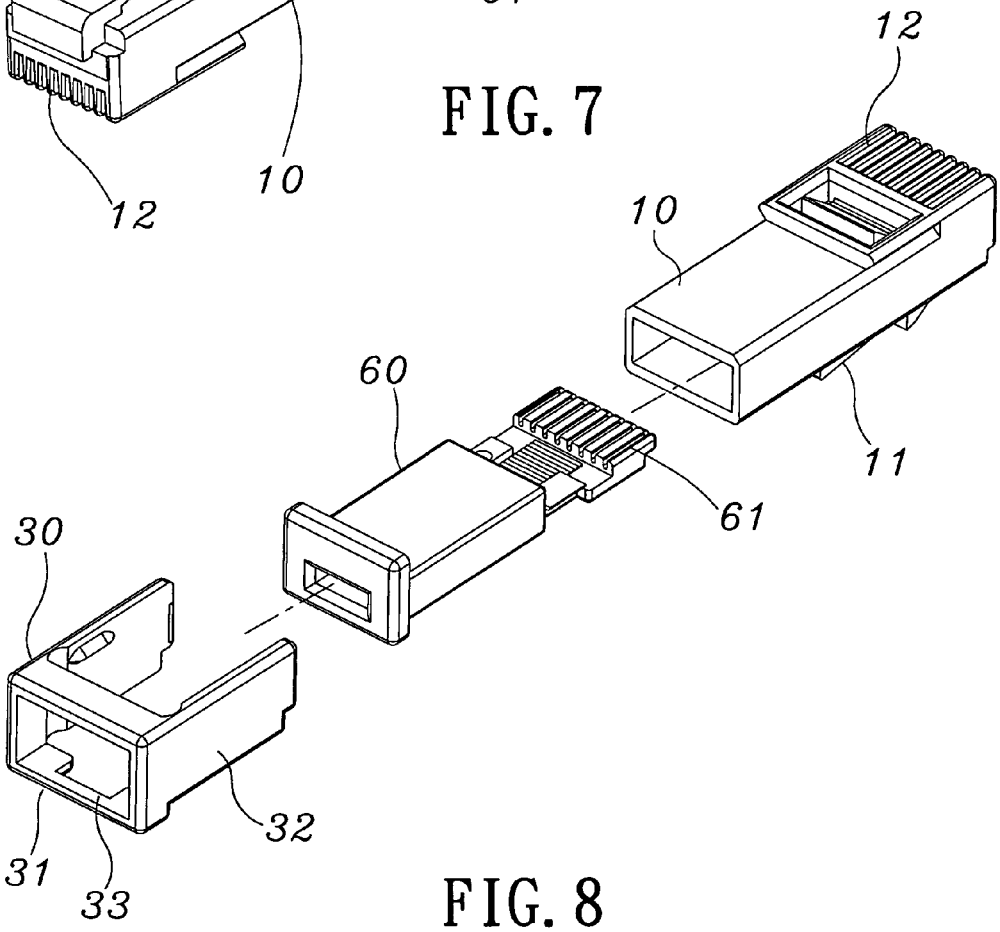
FIG. 8 is an exploded perspective view from another angle of the plug connector of the third embodiment of the present invention.
Figure 9:
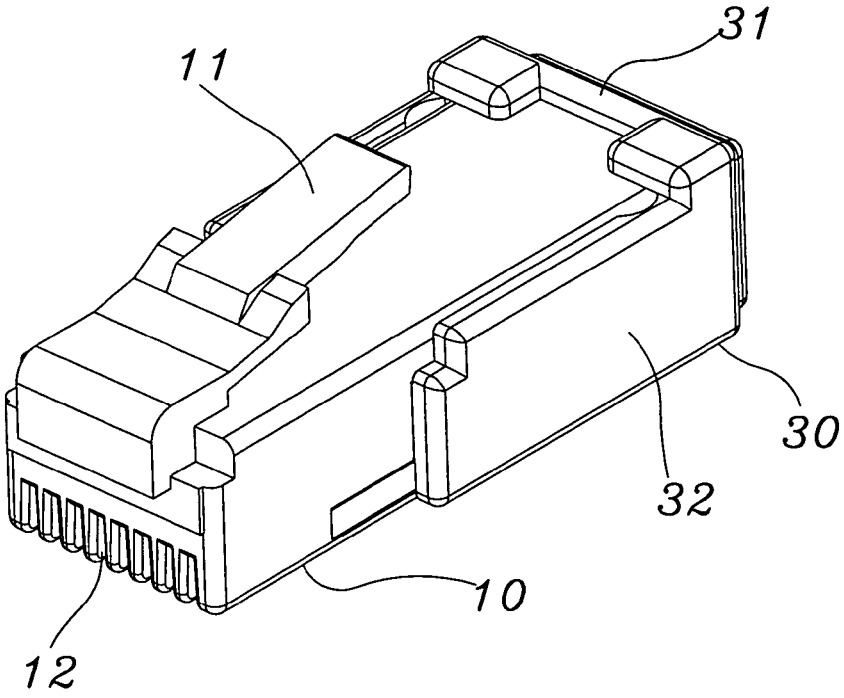
FIG. 9 is a perspective view of the plug connector of the third embodiment of the present invention.
Figure 10:
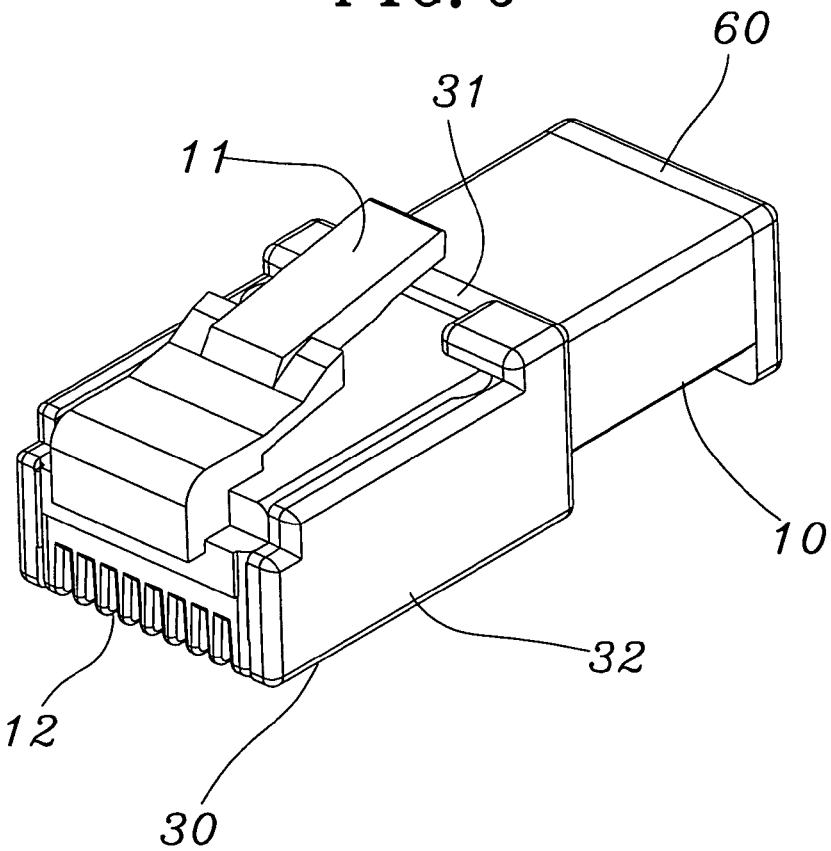
FIG. 10 is a perspective view of the plug connector of the third embodiment of the present invention under another use condition.
Figure 11:
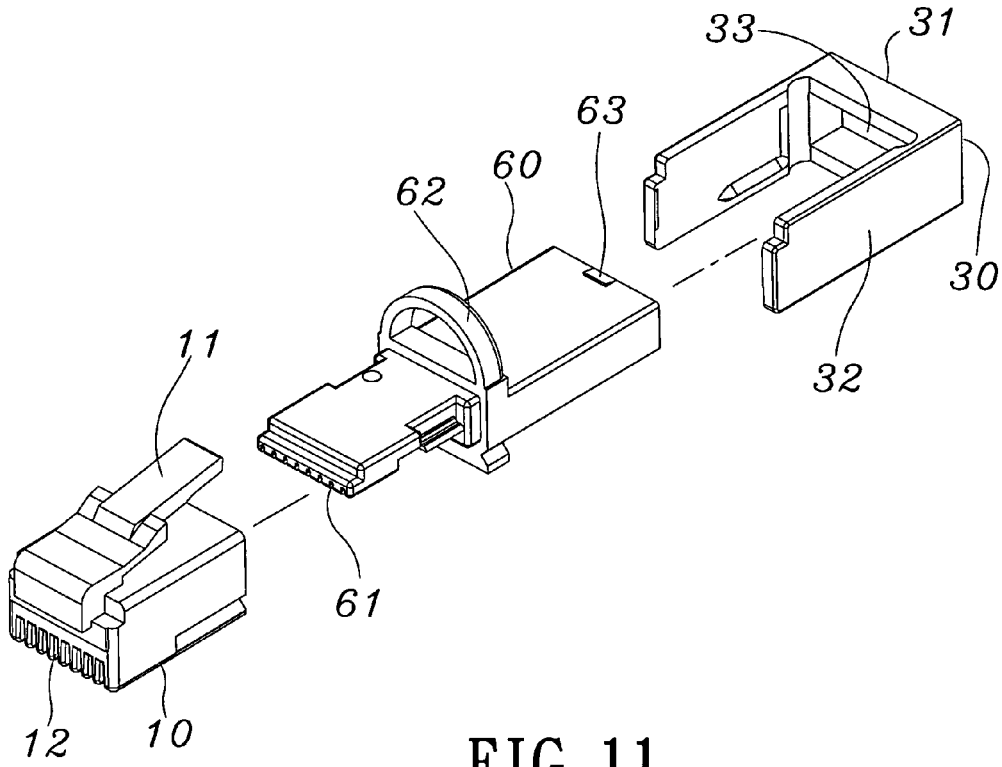
FIG. 11 is an exploded perspective view of a plug connector of a fourth embodiment of the present invention.
Figure 12:
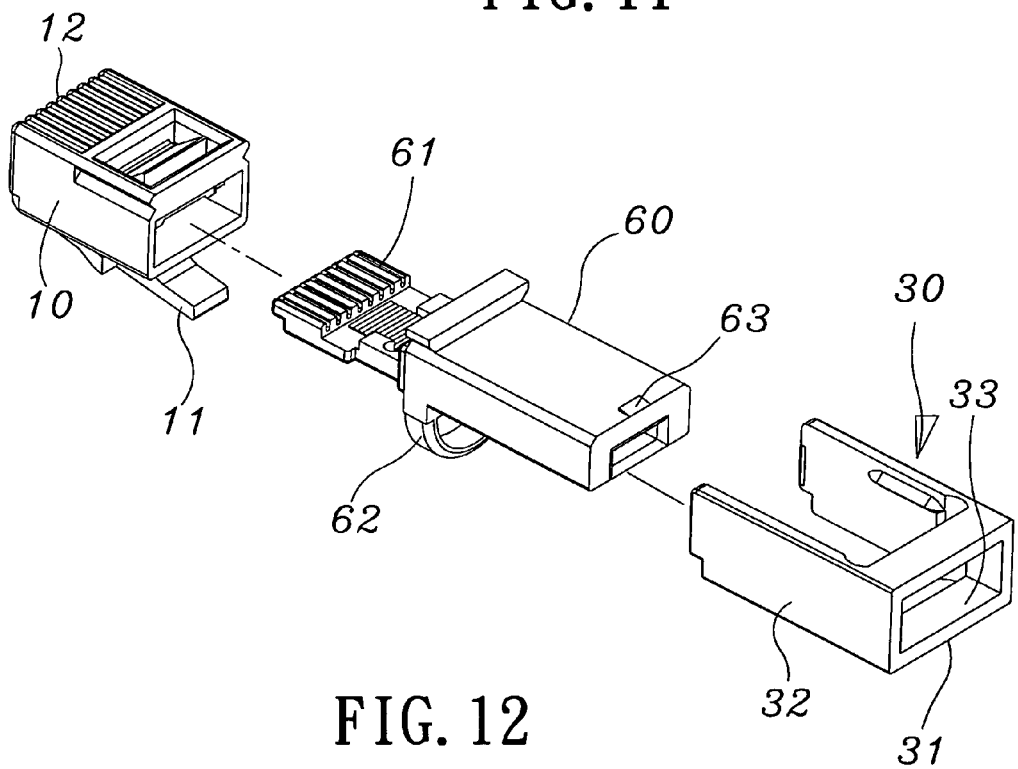
FIG. 12 is an exploded perspective view from another angle of the plug connector of the fourth embodiment of the present invention.
Figure 13:
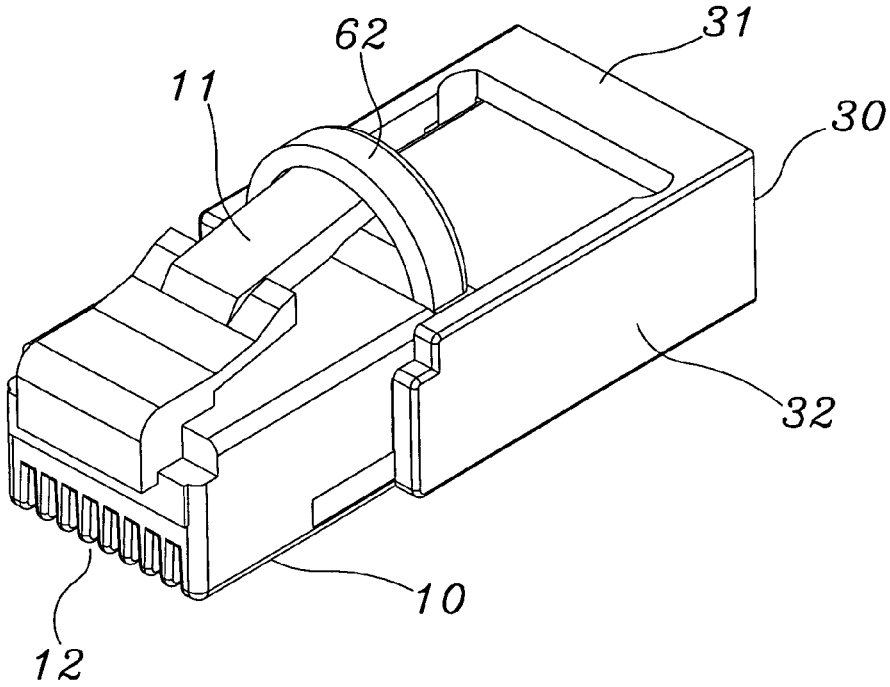
FIG. 13 is a perspective view of the plug connector of the fourth embodiment of the present invention.
Figure 14:
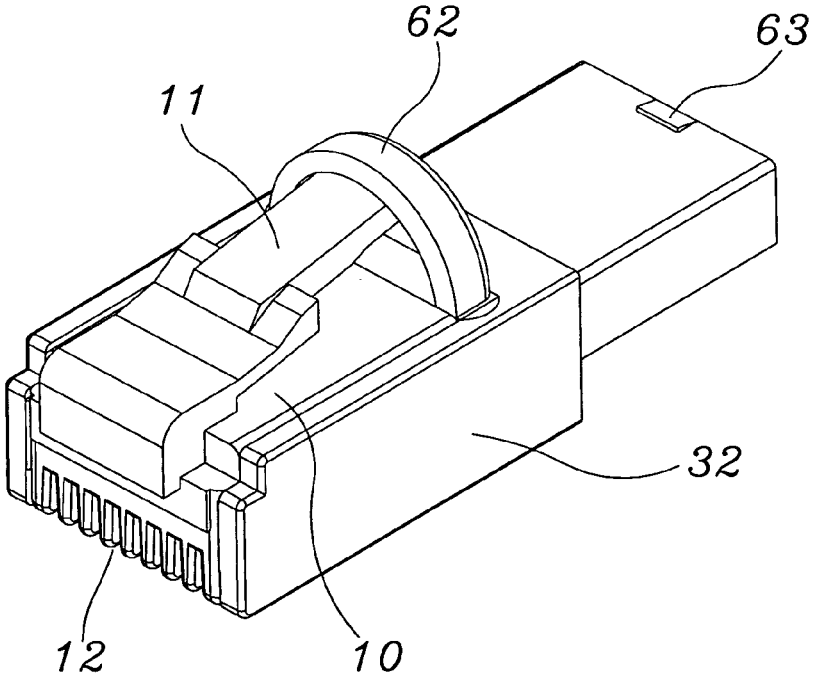
FIG. 14 is a perspective view of the plug connector of the fourth embodiment of the present invention under another use condition.

When the adapter sleeve 30 is forward moved in the second position (shown in FIG. 5), the protrusions 34 of the two arms 32 are respectively hooked into the slots 13 at the two sides of the middle position and two front edges of the insulating housing 10. Thus the adapter sleeve 30 can be securely positioned at a front-half portion of the insulating housing 10.

The conductive wires 40 are extended into an inside of the insulating housing from a rear of the insulating housing. The outer layer of the conductive lines 40 are pierced by the piercing end of the terminal grooves 12, so that the terminals 20 can be electrically connected to the conductive wires 40.

In the present invention, the plug connector mainly provides a technical feature in that the adapter sleeve 30 is moveably adjusted on the insulating housing 10 for use with jacks of different standards. When the adapter sleeve 30 is backward moved in the first position, the front-half portion of the plug connector has a small standard dimension, for insertion into a complementary jack connector of the smaller standard (shown in FIG. 4). When the adapter sleeve 30 is moved forward into the second position, the adapter sleeve 30 is coupled at the front-half portion of the insulating housing 10, so that the front-half portion of the plug connector has a larger width to obtain a large standard dimension for insertion into another complementary jack connector of the larger standard (shown in FIG. 5).

Furthermore, the present invention can enable the plug connector to obtain different size standards due to the movement of the adapter sleeve 30, so that the insulating housing 10 with the single size standard can be used with two standards. The present invention also can be simultaneously applied in different standards of plug and inserted in different standards of jack. When a factory owner wants to manufacture different standards of plug, he doesn't need new molds to manufacture different sizes of insulating housing, thereby effectively reducing the manufacturing cost. Furthermore, standard adaption is extremely easy.

Additionally, referring to FIGS. 7 to 10, the shapes and structures of the insulating housing 10 and the adapter sleeve 30 also can provide different variations. The adapter sleeve 30 can be coupled on the insulating housing 10, and the adapter sleeve 30 can be moved between the first position and the second position (shown in FIGS. 9 and 10). This embodiment further includes a connecting body 60 made of a plastic material. The inside of the connecting body 60 can be penetrated by a plurality of conductive lines (not shown). The connecting body 60 has a plurality of line grooves 61. The conductive lines are inserted into the line grooves 61 from a rear end of the connecting body 60. The connecting body 60 is inserted from a rear end of the insulating housing 10, so that the connecting body 60 and with the conductive lines 61 are extended into an inside of the insulating housing 10. The connecting body 60 is fastened in the inside of the insulating housing 10. Thus the connecting body 60 and the insulating housing 10 can be combined into one piece. The terminals 20 are pressed into the line grooves 61, so that the outer layer of the conductive lines can pierce through the piercing end of the terminals 20 for achieving an electrical connection.

Additionally, referring to FIGS. 11 to 14, the shapes and structures of the insulating housing 10 and the adapter sleeve 30 also can obtain different variations. The adapter sleeve 30 can be coupled on the insulating housing 10, and the adapter sleeve 30 can be moved between the first position and the second position (shown in FIGS. 13 and 14). This embodiment mainly provides a protection element 62 formed at an outer side of the connecting body 60. When the connecting body 60 and the insulating housing 10 are combined together, the protection element 62 is arranged on an outer of the tongue element 11 of the insulating housing 10. The protection element 62 can prevent the tongue element 11 from being broken in collision or incautiously hooking other articles. Furthermore, the lifetime of the tongue element 11 can be substantially increased. The connecting body 60 has a bulge 63 formed thereon. When the transferring element 30 is in the first position, it can be positioned via the bulge 63.

There has thus been described a new, novel and heretofore unobvious plug connector which eliminates the aforesaid problem in the prior art. Furthermore, those skilled in the art will readily appreciate that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A plug connector for use with jacks of different standards, comprising:

an insulating housing having a plurality of terminal grooves formed in a front end thereof, the front end having a width corresponding to a width of a jack of a first standard;

a plurality of terminals respectively arranged in the terminal grooves; and an adapter sleeve slideably disposed on the insulating housing, the adapter sleeve being (a) positionable at a rear end of the insulating housing for mating the front end of the insulating housing with a jack of the first standard, and (b) positionable at the front end of the insulating housing for mating the front end of the insulating housing and adapter sleeve with a jack of a second standard, the jack of the second standard having a width greater than the width of the jack of the first standard.

2. The plug connector of claim 1, further comprising a plurality of conductive wires passing into the rear end of the insulating housing, and being respectively electrically connected to the plurality of terminals.

3. The plug connector of claim 1, further comprising a jack mounted to the rear end of the insulated housing and having contacts respectively electrically connected to the plurality of terminals.

4. The plug connector of claim 1, further comprising a plug mounted to the rear end of the insulating housing and having contacts respectively electrically connected to the plurality terminals.

5. The plug connector of claim 1, wherein the adapter sleeve is formed by a main body and two arms respectively extending from two sides of the main body, the main body having a receiving opening formed therethrough and into which the insulating housing is received.

6. The plug connector of claim 1, further comprising a positioning mechanism for providing detents to position the adapter sleeve at the front and rear ends of the insulating housing.

7. The plug connector of claim 6, wherein the positioning mechanism includes a plurality of spaced slots formed in at least one side of the insulating housing, and a plurality of spaced protrusions formed on at least one side of the adapter sleeve, at least one of the plurality of protrusions releaseably engaging a respective one of the plurality of slots when the adapter sleeve is positioned at the front and rear ends of the insulating housing.

8. The plug connector of claim 1, further comprising a connecting body received within the rear end of the insulating housing for providing electrical coupling to the plurality of terminals.

9. The plug connector of claim 8, wherein the insulating housing has a tongue element on an outer side thereof, and the connecting body has a protection element at an outer side thereof disposed to extend over a portion of the tongue element of the insulating housing.

10. The plug connector of claim 8, wherein the connecting body has a bulge formed thereon for positioning the adapter sleeve at the rear end of the insulating housing.

* * * * *